US007391878B2

(12) United States Patent
Liao

(10) Patent No.: US 7,391,878 B2
(45) Date of Patent: Jun. 24, 2008

(54) EARPHONE DEVICE HAVING COMPOSITE FUNCTIONS

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 547 days.

(21) Appl. No.: 11/033,134

(22) Filed: Jan. 12, 2005

(65) Prior Publication Data

US 2006/0153414 A1 Jul. 13, 2006

(51) Int. Cl.
*H04R 25/00* (2006.01)

(52) U.S. Cl. ..... 381/370; 381/371; 381/373

(58) Field of Classification Search ..... 381/309, 381/322, 328, 71.6, 370–374, 376, 380, 345–346, 381/350–351; 379/430, 431, 432
See application file for complete search history.

(56) References Cited

U.S. PATENT DOCUMENTS 4,005,278 A * 1/1977 Gorike ..... 381/373
4,239,945 A * 12/1980 Atoji et al. ..... 381/371
6,788,798 B1 * 9/2004 Backman ..... 381/372

* cited by examiner

*Primary Examiner*—Huyen D. Le
(74) *Attorney, Agent, or Firm*—Rosenberg, Klein & Lee

(57) ABSTRACT

An earphone device having composite functions at least has an earphone shell body, a loudspeaker, and an adjustment component. Several outer sound holes are disposed on the outer side of the earphone shell body. The loudspeaker is fixed in the earphone shell body. The loudspeaker is arranged outwards. The adjustment component is disposed on the earphone shell body. There are several adjustment holes corresponding to the outer sound holes of the earphone shell body on the adjustment component. The adjustment holes of the adjustment component can be controlled to be opposite to or be staggered with the outer sound holes of the earphone shell body. The earphone device is comfortable for use and can reduce pathological changes in ear and hearing decay to keep the human body healthy. Moreover, the earphone device has the functions of earphone, sound amplifier, and sound box.

20 Claims, 12 Drawing Sheets

EARPHONE DEVICE HAVING COMPOSITE FUNCTIONS

BACKGROUND OF THE INVENTION

1. Field of the invention

The present invention relates to, an earphone device having composite functions and, more particularly, to an earphone device capable of keeping a human body healthy and having the functions of earphone, sound amplifier, and sound box.

2. Description of Related Art

Using an earphone to hear sound has become an indispensable life style in modern lives of people. An earphone can be exploited for listening to music on an airplane or for using a walkman, a radio set or a mobile phone in everyday life.

As shown in FIG. 1, in a conventional earphone 9, an inward loudspeaker 92 is disposed in each earphone shell body 91. The loudspeaker 92 is connected with a signal line 93. When the signal is sent to the loudspeaker 92, the loudspeaker 92 emits sound inwards to the ear of a user.

The above conventional earphone or an earphone of another type adopts the design of inward loudspeaker. Sound emitted by the loudspeaker is directly transmitted inwards to the ear of a user. In addition to causing discomfort of the eardrum of the user, the earphone may even cause pathological changes in the ear and hearing decay, hence having an adverse affect on the health of the human body.

Moreover, the conventional earphone generally has only the single function of earphone and provides no other function. Along with development of the information and multimedia technologies, earphones with a single function can no longer meet the requirements of people. In particular, use of a sound amplifier or a sound box requires a separate purchase of earphones, hence resulting in much inconvenience of the user.

SUMMARY OF THE INVENTION

An object of the present invention is to provide an earphone device having composite functions, which can be used more comfortably, and can reduce pathological changes in the ear and hearing decay. Moreover, the earphone device has the functions of earphone, sound amplifier, and sound box to accomplish much convenience in use.

To achieve the above object, the present invention provides an earphone device having composite functions. The earphone device comprises at least an earphone shell body having an outer side portion and an inner side portion, a loudspeaker fixed in the earphone shell body and arranged outwards, and an adjustment component disposed on the earphone shell body. Multiple outer sound holes are formed on the outer side portion of the earphone shell body. The adjustment component has multiple adjustment holes corresponding to the outer sound holes of the earphone shell body. The adjustment holes of the adjustment component can be controlled to be opposite to or be staggered with the outer sound holes of the earphone shell body.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
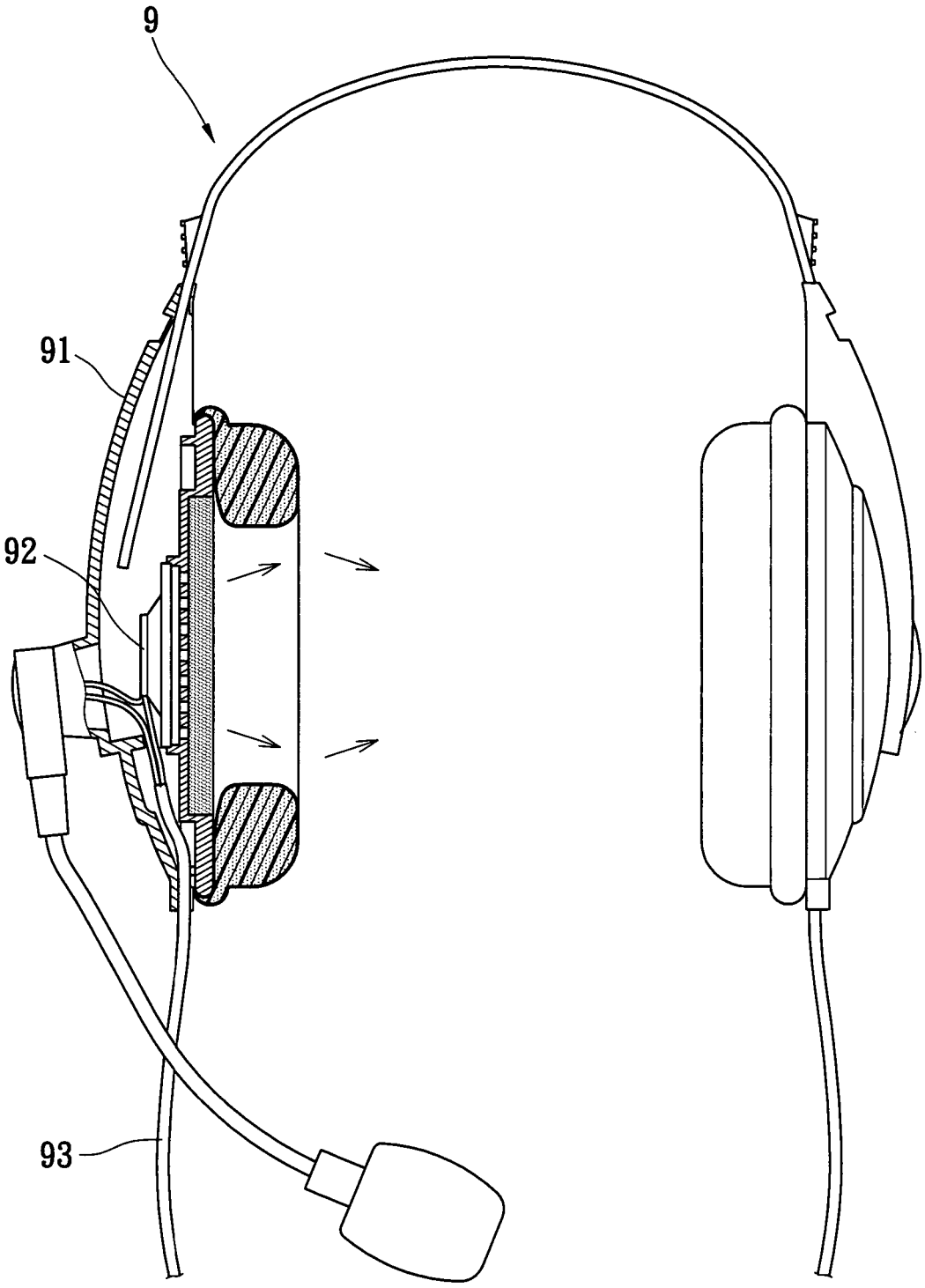
FIG. 1 PRIOR ART
FIG. 1 is a cross-sectional view of a conventional earphone.
Figure 2:
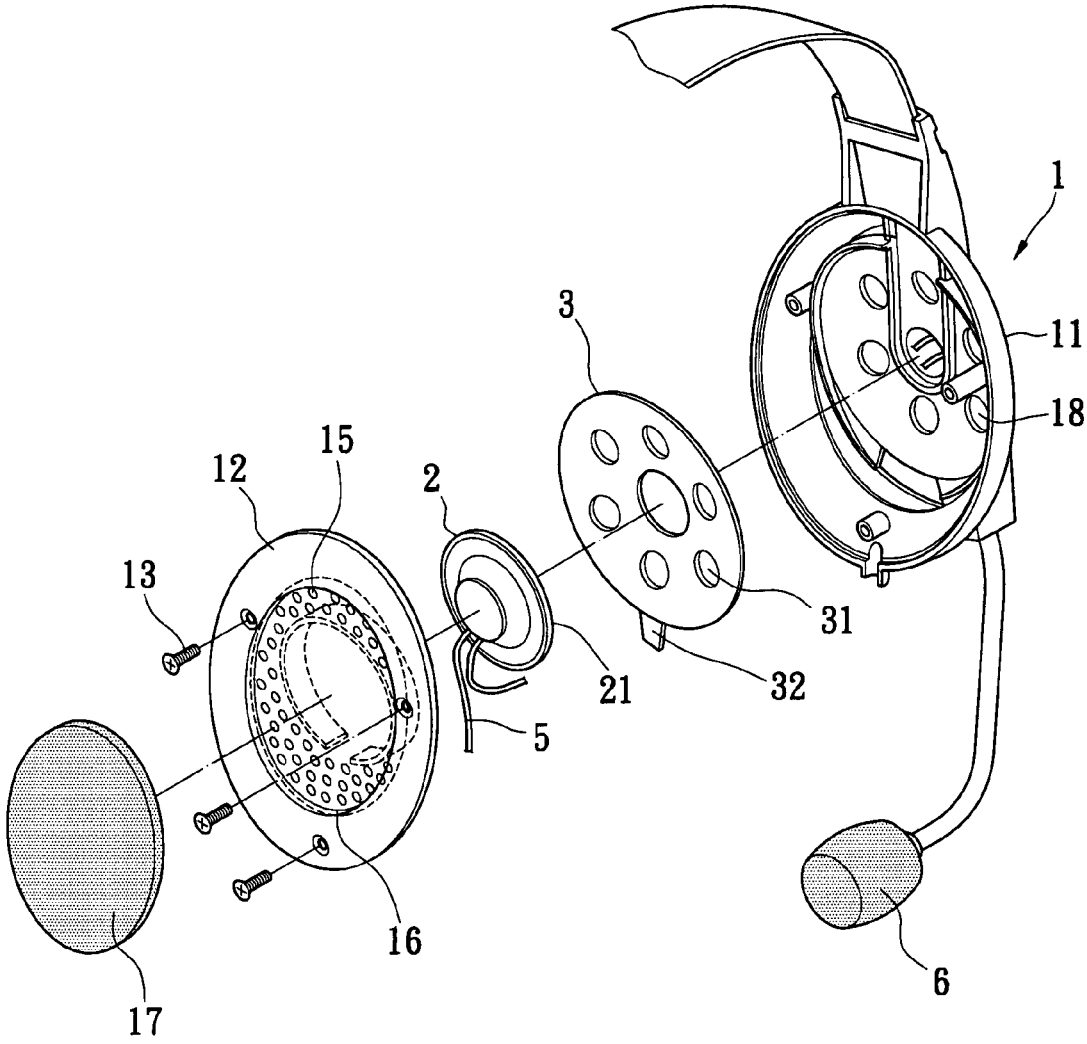
FIG. 2 is an exploded perspective view according to a first embodiment of the present invention.
Figure 3:
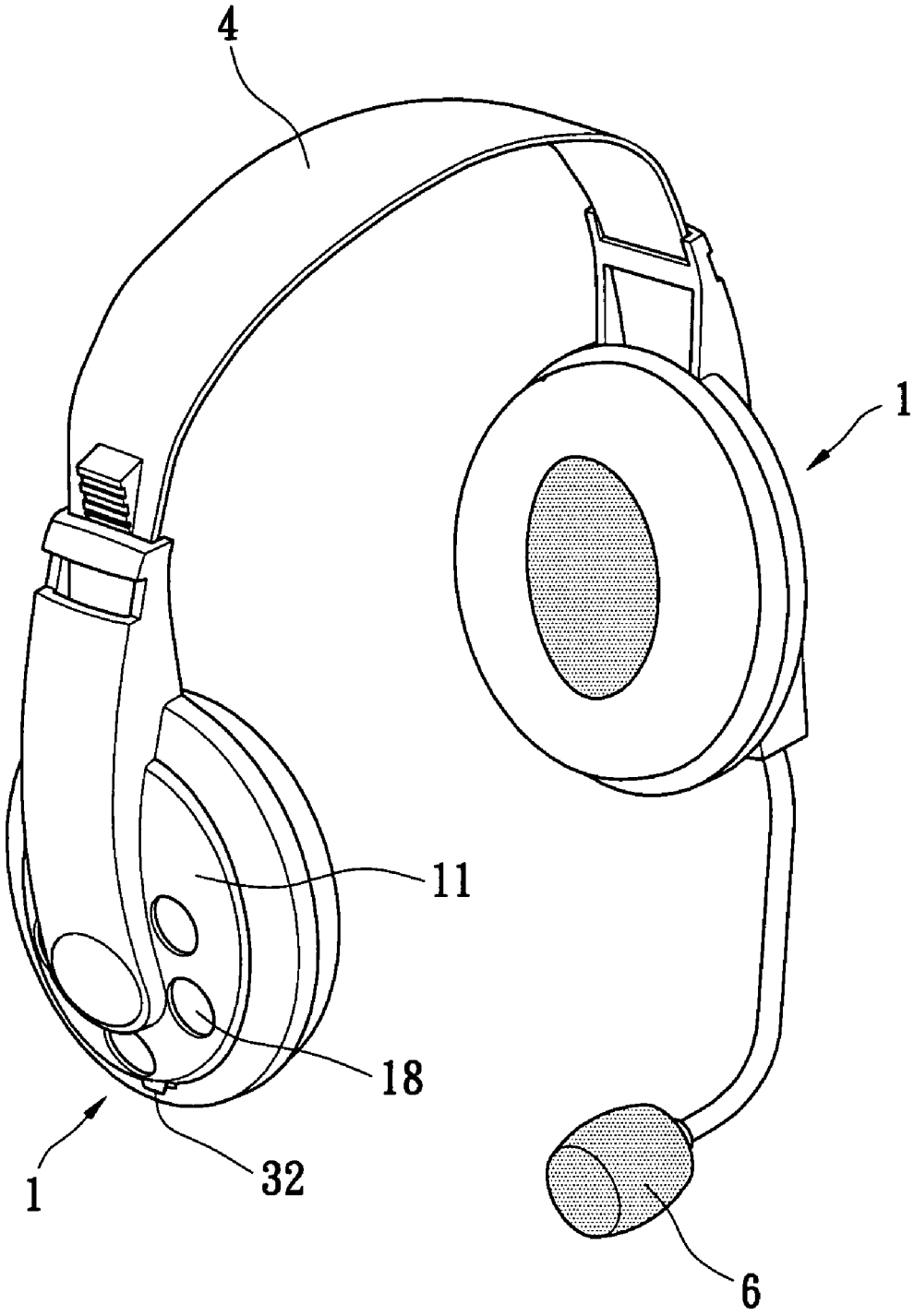
FIG. 3 is a perspective view according to the first embodiment of the present invention.
Figure 4:
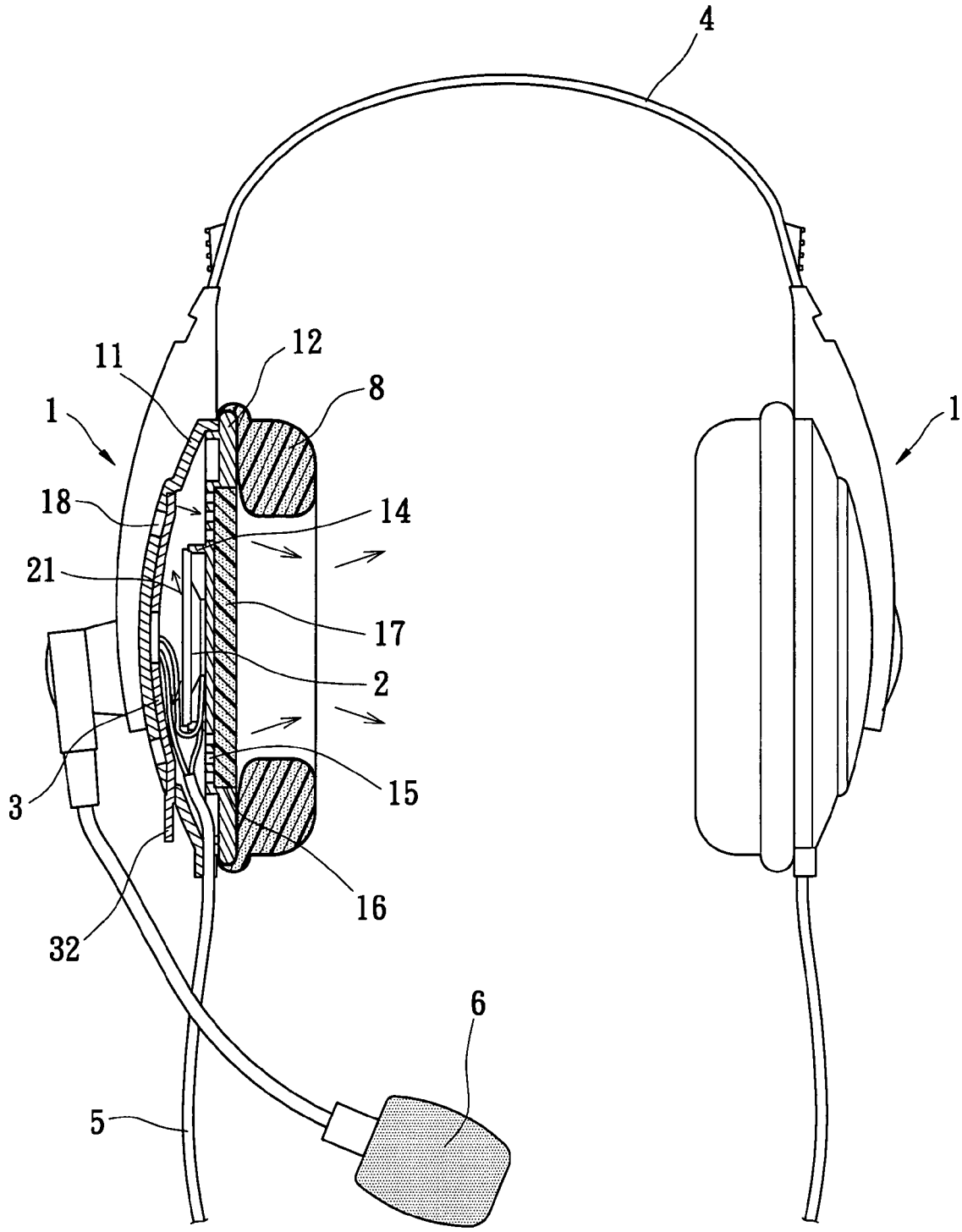
FIG. 4 is a cross-sectional view according to the first embodiment of the present invention.

As shown in FIGS. 2, 3, and 4, the present invention provides an earphone device having composite functions. The type of earphone is not limited. In this embodiment, a headphone is disclosed. The earphone device comprises two earphone shell bodies 1, two loudspeakers 2, and two adjustment components 3. A head belt 4 is connected between the two earphone shell bodies 1 so that the earphone device can be hung on a user's head by the head belt 4. The two earphone shell bodies 1, correspond to two ears of the user. The two loudspeakers 2 and the two adjustment components 3 are disposed in the two earphone shell bodies 1, respectively.

Figure 9:
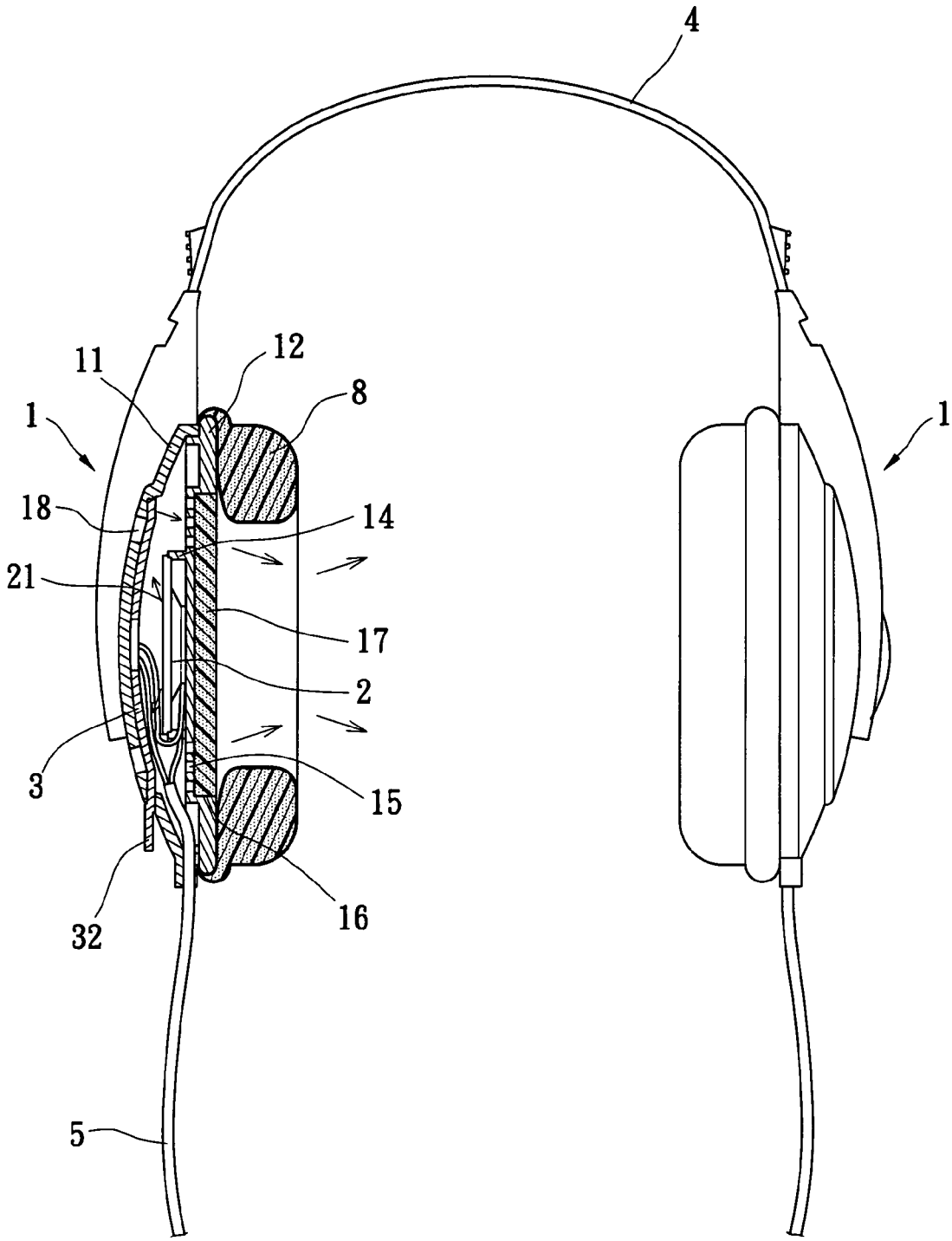
FIG. 9 is a cross-sectional view according to a fifth embodiment of the present invention.

The earphone shell body 1 is composed of an outer side portion 11 and an inner side portion 12. The outer side portion 11 and the inner side portion 12 are assembled together by means of clamping or locking with screws 13 to form the whole earphone shell body 1. An annular fixing base 14 is disposed on the inner face of the inner side portion 12 of the earphone shell body 1. Multiple inner sound holes 15 are formed on the inner side portion 12. The inner sound holes 15 penetrate through inner and outer faces of the inner side portion 12. A groove 16 is formed on the outer face of the inner side portion 12 of the earphone shell body 1. A foam rubber 17 is disposed in the groove 16. The foam rubber 17 covers the inner sound holes 15. Multiple outer sound holes 18 are formed in the outer side portion 11. The outer sound holes 18 penetrate through inner and outer faces of the outer side portion 11. The outer side portion 11 of the earphone shell body 1 can also connect to a microphone 6. The inner side portion 12 of the earphone shell body 1 can also connect to a soft material 8. The microphone 6 can also be saved (as shown in FIG. 9).

The loudspeaker 2 is disposed in the fixing base 14. The loudspeaker 2 is properly fixed in the fixing base 14 by means of adhesion or clamping so that the loudspeaker 2 can be fixed in the earphone shell body 1. The loudspeaker 2 is disposed outwards. That is, a front end face 21 of the loudspeaker 2 faces toward the outer side portion 11 of the earphone shell body 1. The loudspeaker 2 is also properly connected with a signal line 5 or a circuit board. Sound (sound waves) emitted by the loudspeaker 2 can be selectively controlled by using the adjustment component 3 to go out from the outer sound holes 18 or the inner sound holes 15.

The adjustment component 3 is a circular sheet or a sheet of another shape. The adjustment component 3 is rotatably and pivotably disposed in the earphone shell body 1. Multiple adjustment holes 31 corresponding to the outer sound holes 18 of the earphone shell body 1 are disposed on the adjustment component 3. A poke button 32 is protrusively disposed at the fringe of the adjustment component 3. The poke button 32 protrudes out of the earphone shell body 1. A user can conveniently poke the poke button 32 to turn the adjustment component 3 for controlling the adjustment holes 31 on the adjustment component 3 to be opposite to or staggered With the outer sound holes 18 of the earphone shell body 1. An earphone device having composite functions of the present invention is thus formed.

As shown in FIG. 4, when a user controls the adjustment holes 31 (shown in FIG. 2) on the adjustment component 3 to be staggered with the outer sound holes 18 of the earphone shell body 1, the outer sound holes 18 of the earphone shell body 1 is immediately closed by the adjustment component 3. Therefore, sound waves emitted by the loudspeaker 2 are reflected by the closed outer side portion 11 of the earphone shell body 1 and the adjustment component 3 and go out from the inner sound holes 15 of the earphone shell body 1. Because sound waves emitted by the loudspeaker 2 are indirectly transmitted through reflection to the ear of the user, discomfort of the ear drum of the user will be reduced. Moreover, pathological changes in ear and hearing decay will also be reduced, hence accomplishing the function of keeping the human body healthy.

Figure 5:
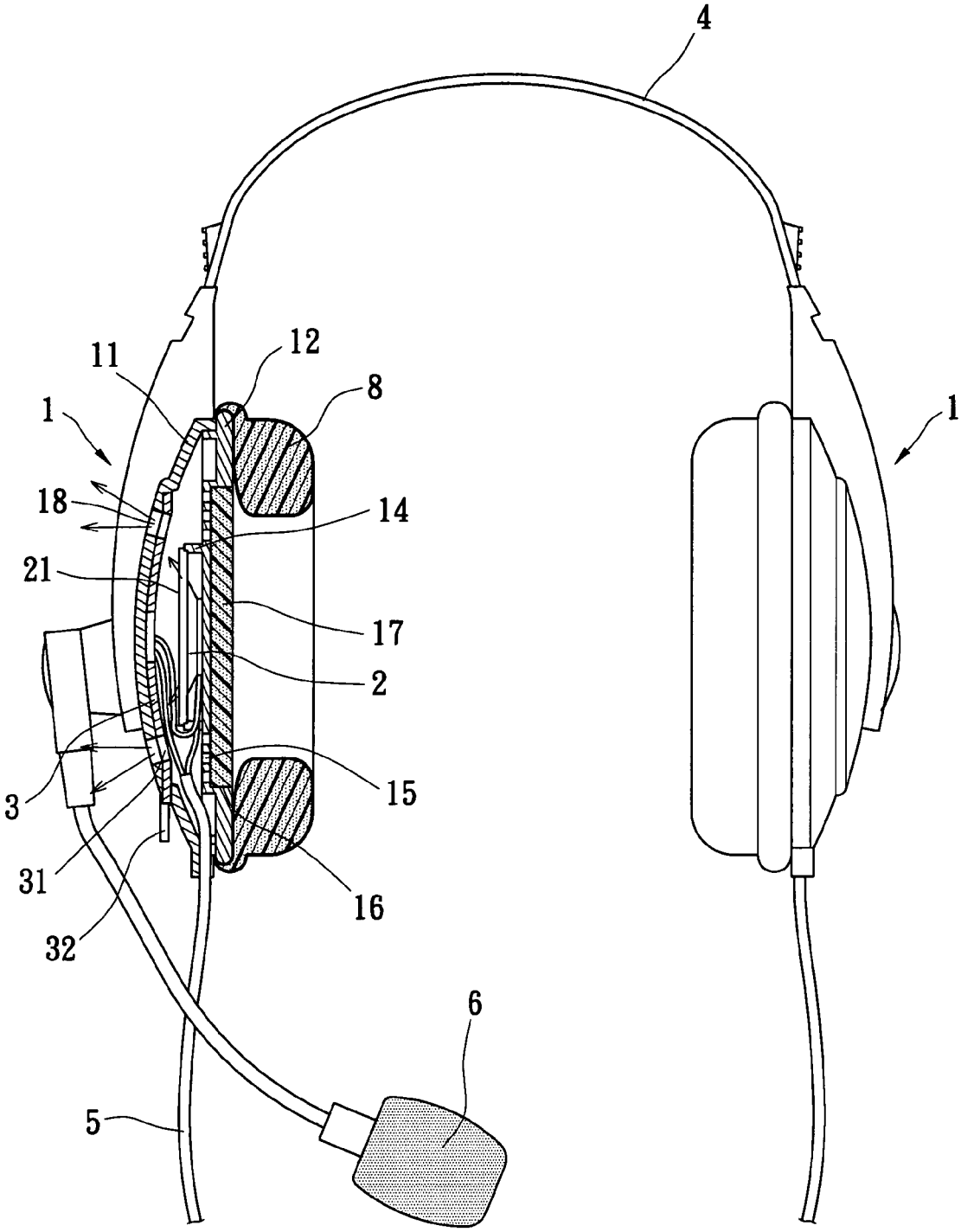
FIG. 5 is a cross-sectional view of another use state according to the first embodiment of the present invention.

Besides, as shown in FIG. 5, when the user controls the adjustment holes 31 on the adjustment component 3 to be opposite to the outer sound holes 18 of the earphone shell body 1, the outer sound holes 18 of the earphone shell body 1 are immediately opened by the adjustment component 3. Therefore, sound waves emitted by the loudspeaker 2 are transmitted out by using the outer sound holes 18 on the outer side portion 11 of the earphone shell body 1 to accomplish the functions of sound amplifier and sound box. The earphone device can be placed at an appropriate place to be used as a sound amplifier and a sound box.

Figure 6:
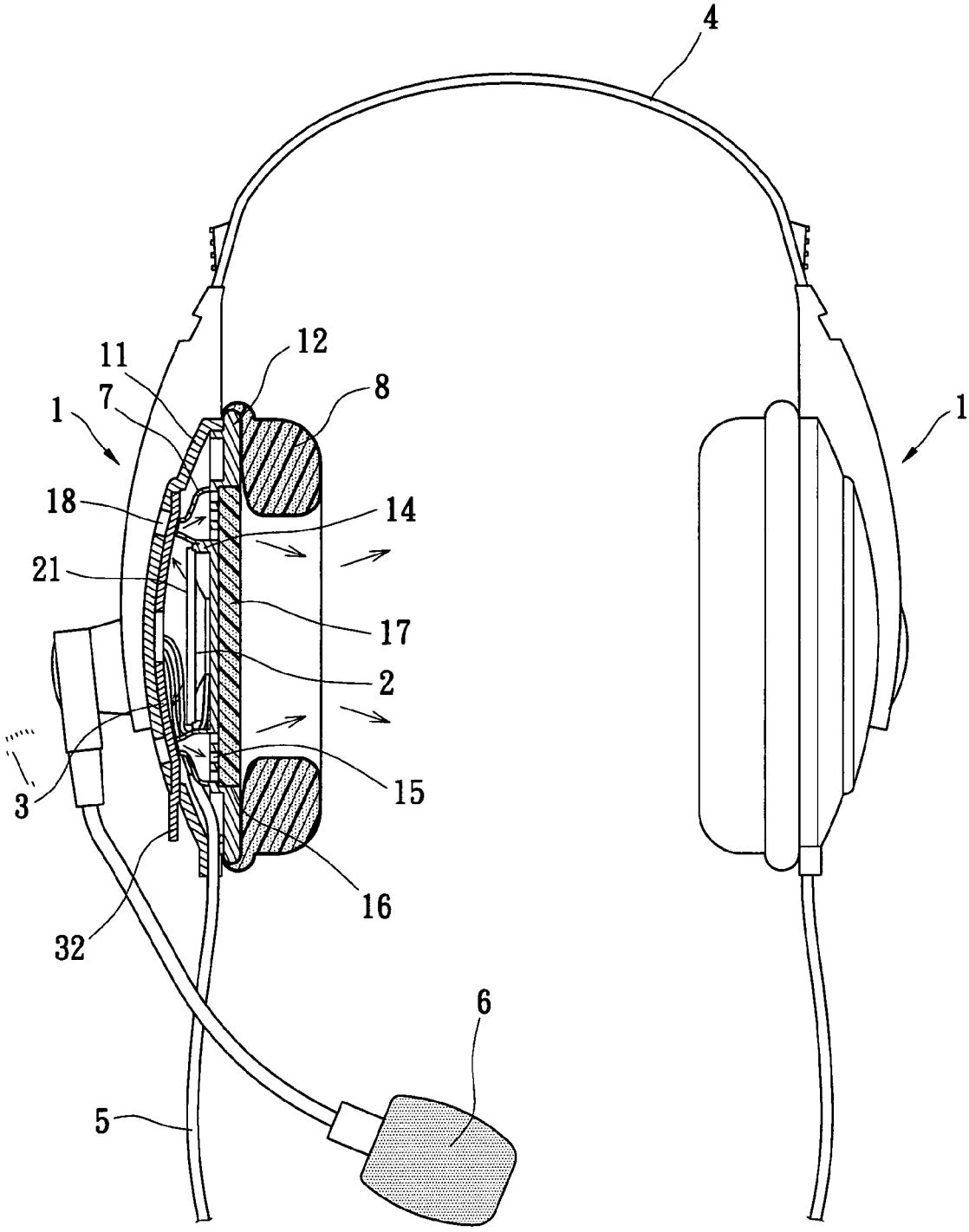
FIG. 6 is a cross-sectional view according to a second embodiment of the present invention.
Figure 6A:
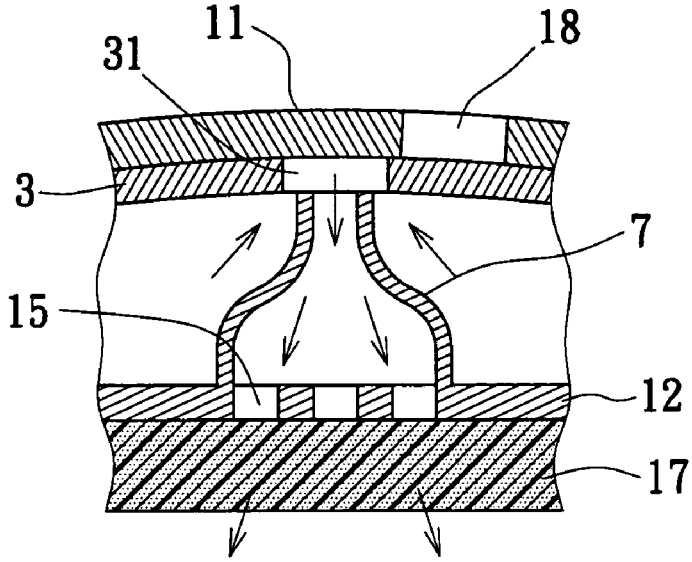
FIG. 6A is a transverse cross-sectional view according to the second embodiment of the present invention.
Figure 6B:
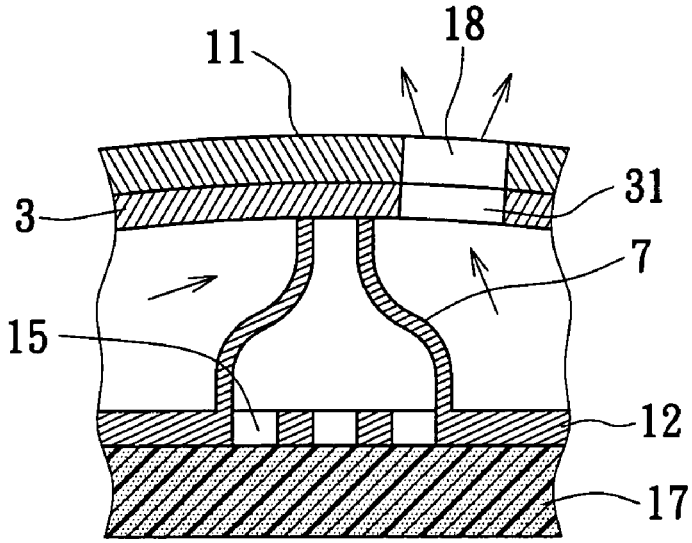
FIG. 6B is a transverse cross-sectional view of another use state according to the second embodiment of the present invention.

As shown in FIGS. 6 and 6A, a sound guiding pipe 7 can further be disposed in the earphone shell body 1. The sound guiding pipe 7 is a pipe with two open ends, which face inwards and outwards, respectively. When the user controls the adjustment holes 31 on the adjustment component 3 to be staggered with the outer sound holes 18 of the earphone shell body 1, the outer sound holes 18 of the earphone shell body 1 are immediately closed by the adjustment component 3. Therefore, sound waves emitted by the loudspeaker 2 are reflected by the closed outer side portion 11 of the earphone shell body 1 and the adjustment component 3, be guided inwards by the sound guiding pipe 7, and then go out from the inner sound holes 15 of the earphone shell body 1. As shown in FIG. 6B, when the user controls the adjustment holes 31 on the adjustment component 3 to be opposite the outer sound holes 18 of the earphone shell body 1, the outer end of the sound guiding pipe 7 is shut by the adjustment component 3. The outer sound holes 18 of the earphone shell body 1 is opened by the adjustment component 3. Therefore, sound waves emitted by the loudspeaker 2 are transmitted out by using the outer sound holes 18 in the outer side portion 11 of the earphone shell body 1 to accomplish the functions of sound amplifier and sound box.

Figure 7:
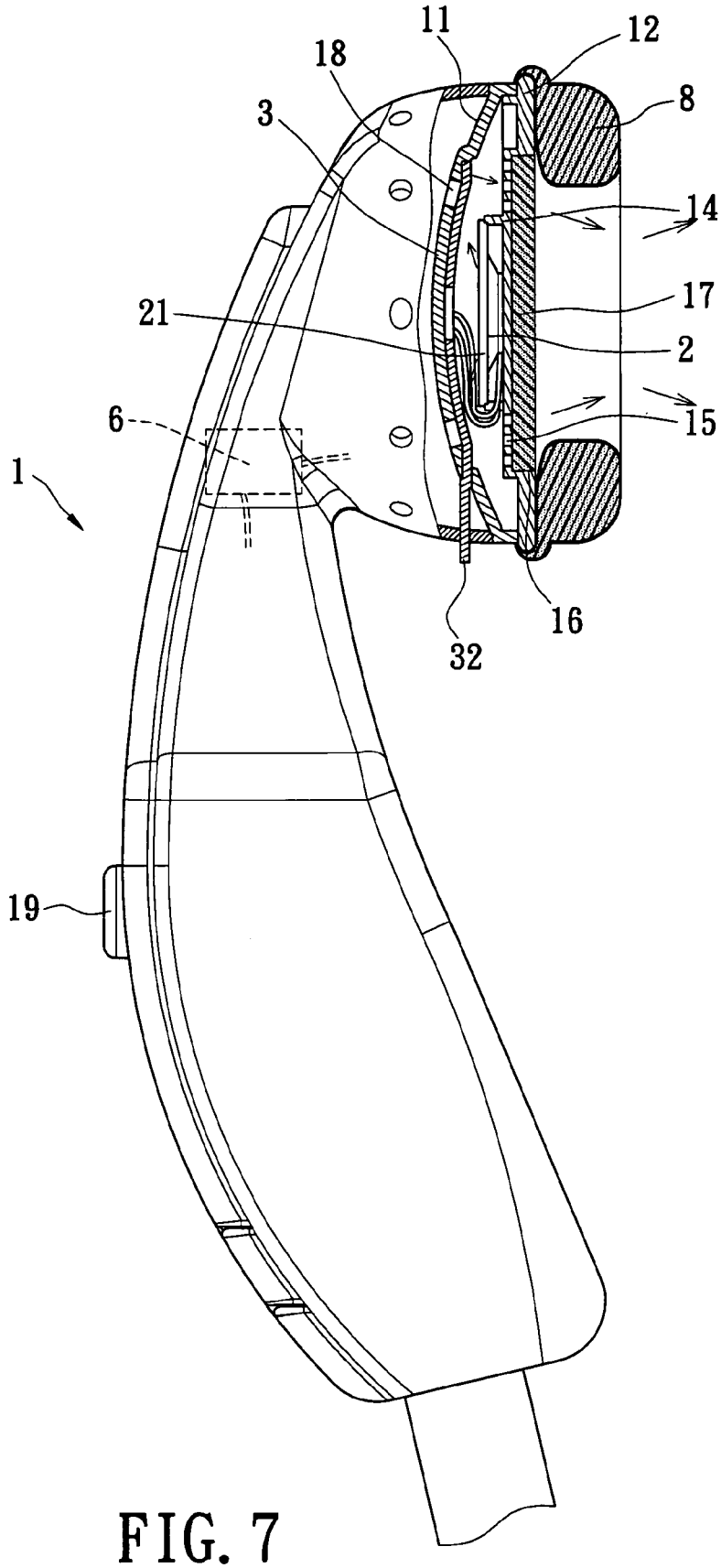
FIG. 7 is a cross-sectional view according to a third embodiment of the present invention.
Figure 8:
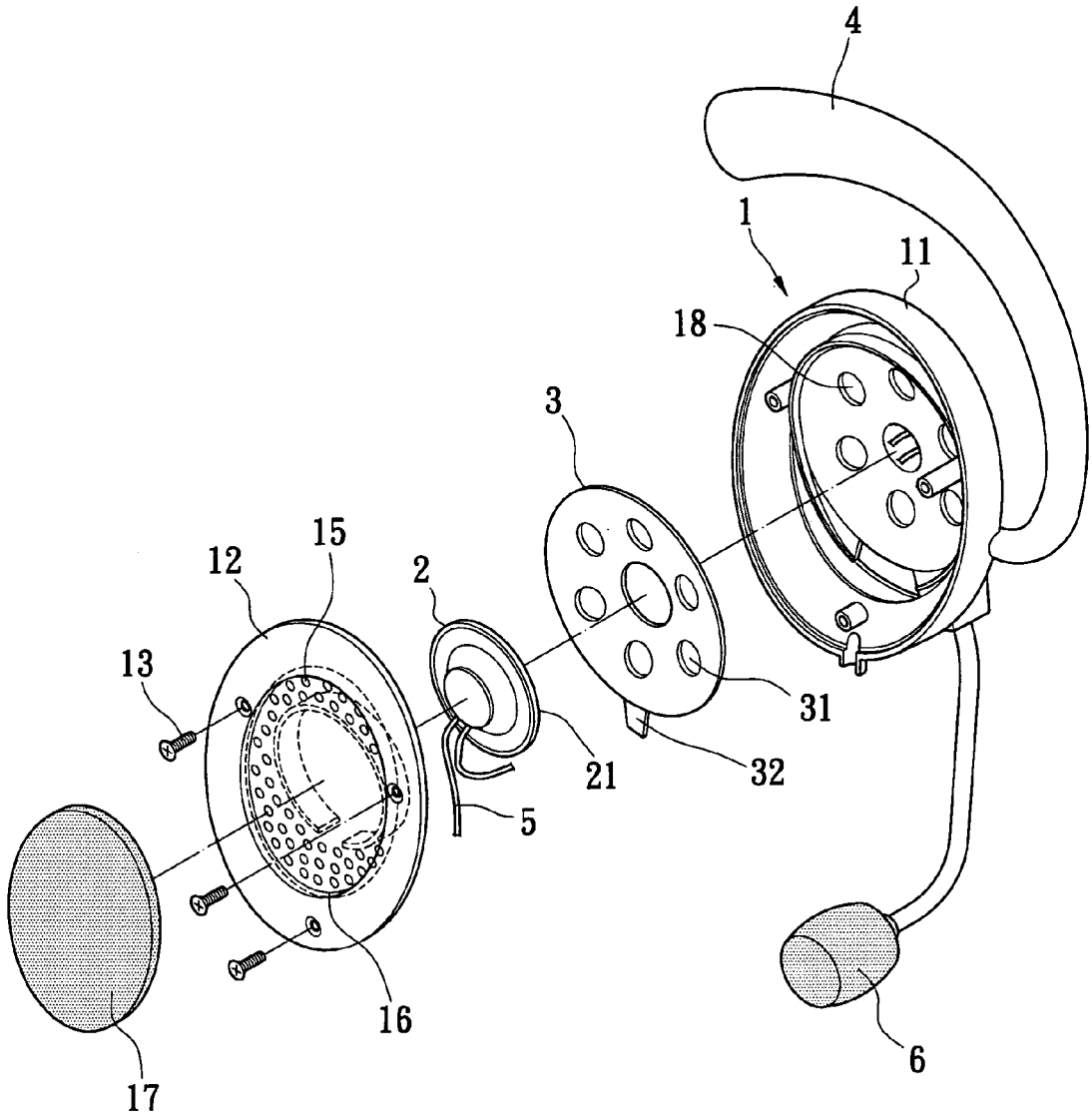
FIG. 8 is an exploded perspective view according to a fourth embodiment of the present invention.
Figure 10:
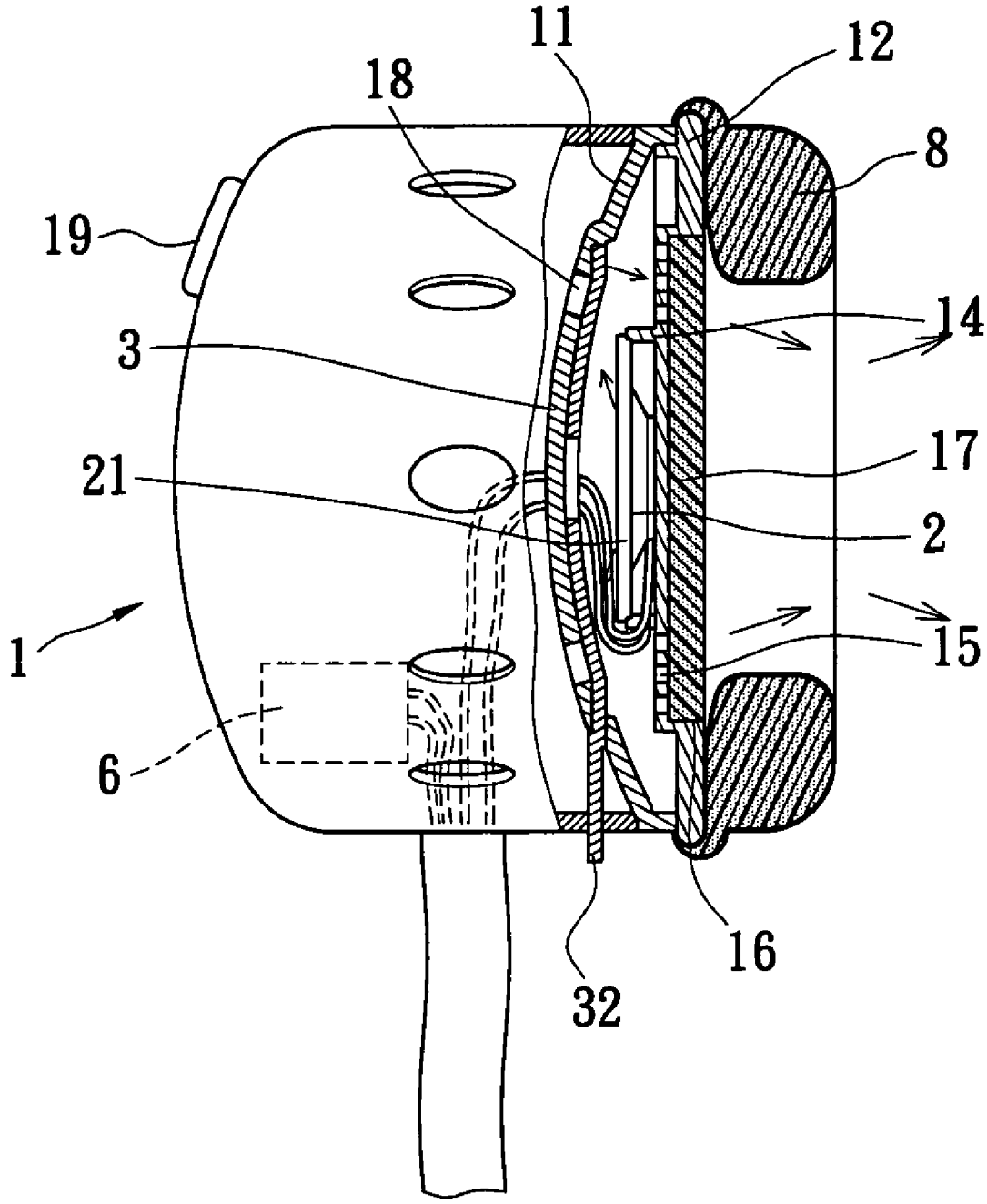
FIG. 10 is a cross-sectional view according to a sixth embodiment of the present invention.
Figure 11:
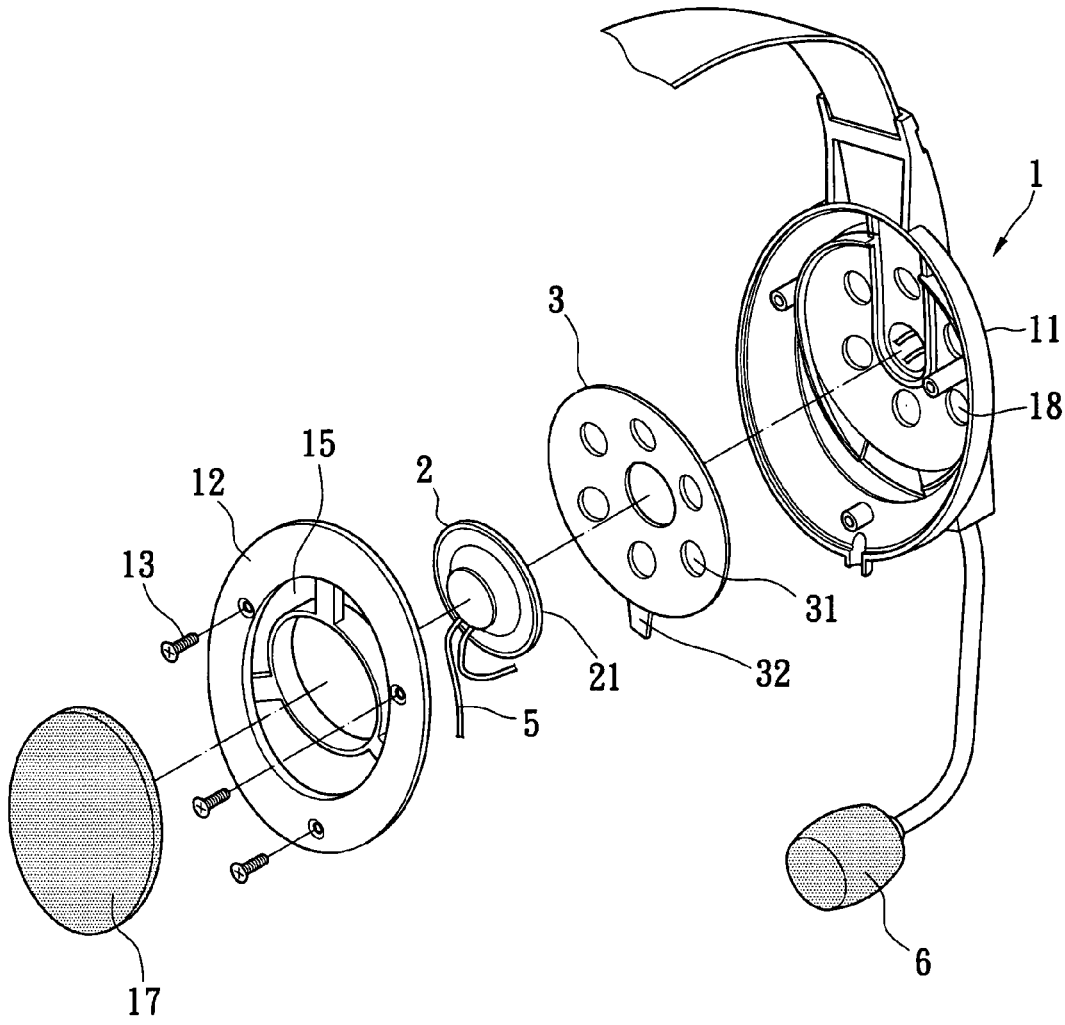
FIG. 11 is an exploded perspective view according to a seventh embodiment of the present invention.

Furthermore, the present invention can also be applied to the common earplug type earphone (as shown in FIGS. 7 and 10) or ear hang type earphones (as shown in FIG. 8). The structure is approximately the same as that of the above embodiments and thus are not further described below. As shown in FIG. 7, the microphone 6 can also be arranged in the earphone shell body 1, and a switch 19 is provided on the earphone shell body 1 for controlling operations of the loudspeaker 2 and the microphone 6. Moreover, the shape and structure of the inner side portion 12 and the inner sound holes 15 of the earphone shell body 1 of the present invention can be varied (as shown in FIG. 11).

Although the present invention has been described with reference to the preferred embodiment thereof, it will be understood, that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. An earphone device having composite functions at least comprising:

an earphone shell body having an outer side portion and an inner side portion, wherein multiple outer sound holes are formed in said outer side portion;

a loudspeaker having a front end face and being fixed in said earphone shell body with said front end face being directed toward said outer side portion; and an adjustment component disposed on said earphone shell body and having multiple adjustment holes formed therethrough corresponding to said outer sound holes of said earphone shell body, wherein said adjustment component is displaceable to adjustably position said adjustment holes between being in full open communication with said outer sound holes of said earphone shell body to output sound through said adjustment holes and said outer sound holes and being in a closed position with respect to said outer sound holes of said earphone shell body to reflect sound back into said earphone shell body.

2. The earphone device having composite functions as claimed in claim 1, wherein said outer side portion and said inner side portion of said earphone shell body are assembled together by means of clamping or screws.

3. The earphone device having composite functions as claimed in claim 1, wherein a fixing base is disposed in said inner side portion of said earphone shell body, and said loudspeaker is disposed in said fixing base.

4. The earphone device having composite functions as claimed in claim 1, wherein a microphone is disposed outside or inside said earphone shell body.

5. The earphone device having composite functions as claimed in claim 1, wherein multiple inner sound holes are disposed on said inner side portion of said earphone shell body, said inner sound holes penetrate through inner and outer faces of said inner side portion, a groove is disposed in the outer face of said inner side portion of said earphone shell body, a foam rubber is disposed in said groove, and said foam rubber covers said inner sound holes.

6. The earphone device having composite functions as claimed in claim 1, wherein a sound guiding pipe is disposed in said earphone shell body.

7. The earphone device having composite functions as claimed in claim 1, wherein said loudspeaker is connected with a signal line or a circuit board.

8. The earphone device having composite functions as claimed in claim 1, wherein said adjustment component is a rotatably and pivotably disposed in said earphone shell body, a poke button is protrusively disposed on said adjustment component, and said poke button protrudes out of said earphone shell body.

9. The earphone device having composite functions as claimed in claim 1, wherein said earphone device is a headphone comprising two earphone shell bodies, two loudspeakers, and two adjustment components, a head belt is connected between said two earphone shell bodies, and said two loudspeakers and said two adjustment components are disposed in said two earphone shell bodies, respectively.

10. The earphone device having composite functions as claimed in claim 1, wherein said earphone device is of an earplug type or ear hang type.

11. An earphone device having composite functions at least comprising:

an earphone shell body having an outer side portion and an inner side portion, wherein multiple outer sound holes are formed in said outer side portion, multiple inner sound holes are disposed on said inner side portion of said earphone shell body, said inner sound holes penetrate through inner and outer faces of said inner side portion, a groove is disposed in the outer face of said inner side portion of said earphone shell body, a foam rubber is disposed in said groove, and said foam rubber covers said inner sound holes;

a loudspeaker fixed in said earphone shell body and arranged outwards directed to said outer side portion; and an adjustment component disposed on said earphone shell body and having multiple adjustment holes corresponding to said outer sound holes of said earphone shell body, wherein said adjustment holes of said adjustment component are controlled to be opposite to or be staggered with said outer sound holes of said earphone shell body.

12. The earphone device having composite functions as claimed in claim 11, wherein a fixing base is disposed in said inner side portion of said earphone shell body, and said loudspeaker is disposed in said fixing base.

13. The earphone device having composite functions as claimed in claim 11, wherein a sound guiding pipe is disposed in said earphone shell body.

14. The earphone device having composite functions as claimed in claim 11, wherein said adjustment component is a rotatably and pivotably disposed in said earphone shell body, a poke button is protrusively disposed on said adjustment component, and said poke button protrudes out of said earphone shell body.

15. The earphone device having composite functions as claimed in claim 11, wherein said earphone device is a headphone comprising two earphone shell bodies, two loudspeakers, and two adjustment components, a head belt is connected between said two earphone shell bodies, and said two loudspeakers and said two adjustment components are disposed in said two earphone shell bodies, respectively.

16. An earphone device having composite functions at least comprising:

an earphone shell body having an outer side portion and an inner side portion, wherein multiple outer sound holes are formed in said outer side portion;

a loudspeaker fixed in said earphone shell body and arranged outwards directed to said outer side portion; and an adjustment component disposed on said earphone shell body and having multiple adjustment holes corresponding to said outer sound holes of said earphone shell body, wherein said adjustment holes of said adjustment component are controlled to be opposite to or be staggered with said outer sound holes of said earphone shell body, said adjustment component is a rotatably and pivotably disposed in said earphone shell body, a poke button is protrusively disposed on said adjustment component, and said poke button protrudes out of said earphone shell body.

17. The earphone device having composite functions as claimed in claim 16, wherein a fixing base is disposed in said inner side portion of said earphone shell body, and said loudspeaker is disposed in said fixing base.

18. The earphone device having composite functions as claimed in claim 16, wherein multiple inner sound holes are disposed on said inner side portion of said earphone shell body, said inner sound holes penetrate through inner and outer faces of said inner side portion, a groove is disposed in the outer face of said inner side portion of said earphone shell body, a foam rubber is disposed in said groove, and said foam rubber covers said inner sound holes.

19. The earphone device having composite functions as claimed in claim 16, wherein a sound guiding pipe is disposed in said earphone shell body.

20. The earphone device having composite functions as claimed in claim 16, wherein said earphone device is a headphone comprising two earphone shell bodies, two loudspeakers, and two adjustment components, a head belt is connected between said two earphone shell bodies, and said two loudspeakers and said two adjustment components are disposed in said two earphone shell bodies, respectively.

* * * * *